US005799357A

United States Patent [19]

Taylor

[11] Patent Number: 5,799,357

[45] Date of Patent: Sep. 1, 1998

[54] CLEANING UTENSIL

[76] Inventor: Lilian A. Taylor, 4136 E. Pender Street, British Colombia, Canada, V5C 2MZ

[21] Appl. No.: 859,930

[22] Filed: May 21, 1997

Related U.S. Application Data

[63] Continuation-in-part of Ser. No. 591,279, Jan. 25, 1996, abandoned.

[51] Int. Cl.[6] ..... A47L 13/16

[52] U.S. Cl. ..... 15/244.1; 15/144.4; D32/40; D32/51

[58] Field of Search ..... 15/228, 244.1, 15/244.2, 244.3; D32/40, 51

[56] References Cited

U.S. PATENT DOCUMENTS

| | | | |
|---|---|---|---|
| D. 180,355 | 5/1957 | Blackburn | D32/51 |
| 2,268,403 | 12/1941 | Kingman | 15/244.3 |
| 3,038,188 | 6/1962 | Rebernak | 15/244.1 |
| 3,114,924 | 12/1963 | Morrison | 15/244.2 |
| 3,570,038 | 3/1971 | Jones | 15/244.1 |

*Primary Examiner*—Randall E. Chin

*Attorney, Agent, or Firm*—Townsend and Townsend and Crew

[57] ABSTRACT

A cleaning utensil comprises a handle defining at one end a rigid threaded portion and a substantially cube-shaped sponge having a chamfered corner, said corner providing an opening extending within the sponge forming a hollow channel, said channel being adapted to threadably receive the rigid portion of the handle within the sponge.

8 Claims, 2 Drawing Sheets

CLEANING UTENSIL

RELATED APPLICATION

The present application is a continuation-in-part of U.S. patent application No. 08/591,279, filed Jan. 25, 1996, now abandoned, which is incorporated herein by reference.

FIELD OF THE INVENTION

The present invention relates to the field of cleaning utensils which are particularly useful for cleaning bathtubs, hot tubs, swimming pools and the like wherein there are corners and edges which are difficult to reach by conventional tools and sponges.

BACKGROUND OF THE INVENTION

Numerous cleaning products are currently available for cleaning hot tubs, bathtubs, swimming pools and the like. Generally, these products, although they may be of larger dimension than regular household utensils, do not make any allowances in shape or conformation for the difficult angles, corners and edges which are encountered in the cleaning of large tubs, pools or "spa" type products. As a result, it is often impossible to thoroughly clean the corners and edges as required for proper hygiene.

In most cases, cleaning products simple involve the attachment of an extendible handle onto conventional rectangular, circular or oval sponges. This has proved to be highly unsatisfactory. In U.S. Pat. No. 5,058,233, a rigid support block is provided within the sponge in order to reduce stress on the sponge when altering cleaning surfaces from horizontal to vertical. Merely inserting a block in this way, however, really provides no assistance in corner or edge cleaning.

It is an object of the present invention to obviate or mitigate the above disadvantages.

SUMMARY OF THE INVENTION

The present invention provides a cleaning utensil comprising a handle defining at one end a rigid portion and a substantially cube-shaped sponge having a chamfered corner, said corner providing an opening extending within the sponge forming a hollow channel, said channel being adapted to receive the rigid portion of the handle substantially within the sponge.

The key to the present invention is twofold. Firstly, there is the provision of the chamfered corner, which allows not only for multiple exposed cleaning surfaces but for multiple sharp cleaning corners, the latter of which are essential for the difficult to reach cleaning areas of pools, spas, tubs or any cornered tiled surface. Secondly, there is provided a hollow channel within the sponge for receiving the rigid portion of the handle. What is achieved by the insertion of the handle within the body of the sponge is a high degree of firmness and control of the sponge when cleaning thereby eliminating the need for the user to bend, stretch, kneel or climb in order to clean difficult areas. This feature is particularly important for the physically challenged. There are several means to achieve the mating of the handle and the hollow channel within the sponge, all of which are discussed further hereinbelow.

BRIEF DESCRIPTION OF THE DRAWINGS

The foregoing and other objects features and advantages of the present invention are illustrated by the following non-limiting drawings in which.

PREFERRED EMBODIMENTS OF THE INVENTION

Figure 2:
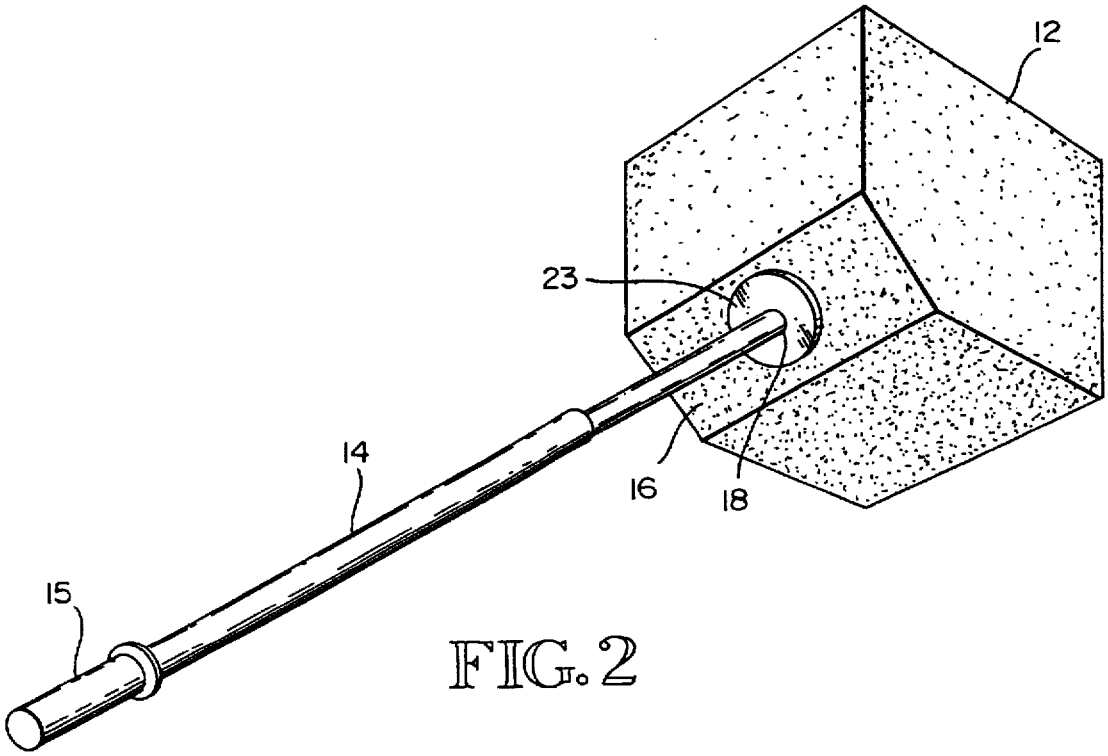
FIG. 2 is another perspective view from below and the side of the cleaning utensil showing the chamfered corner and attachment of the handle.
Figure 3:
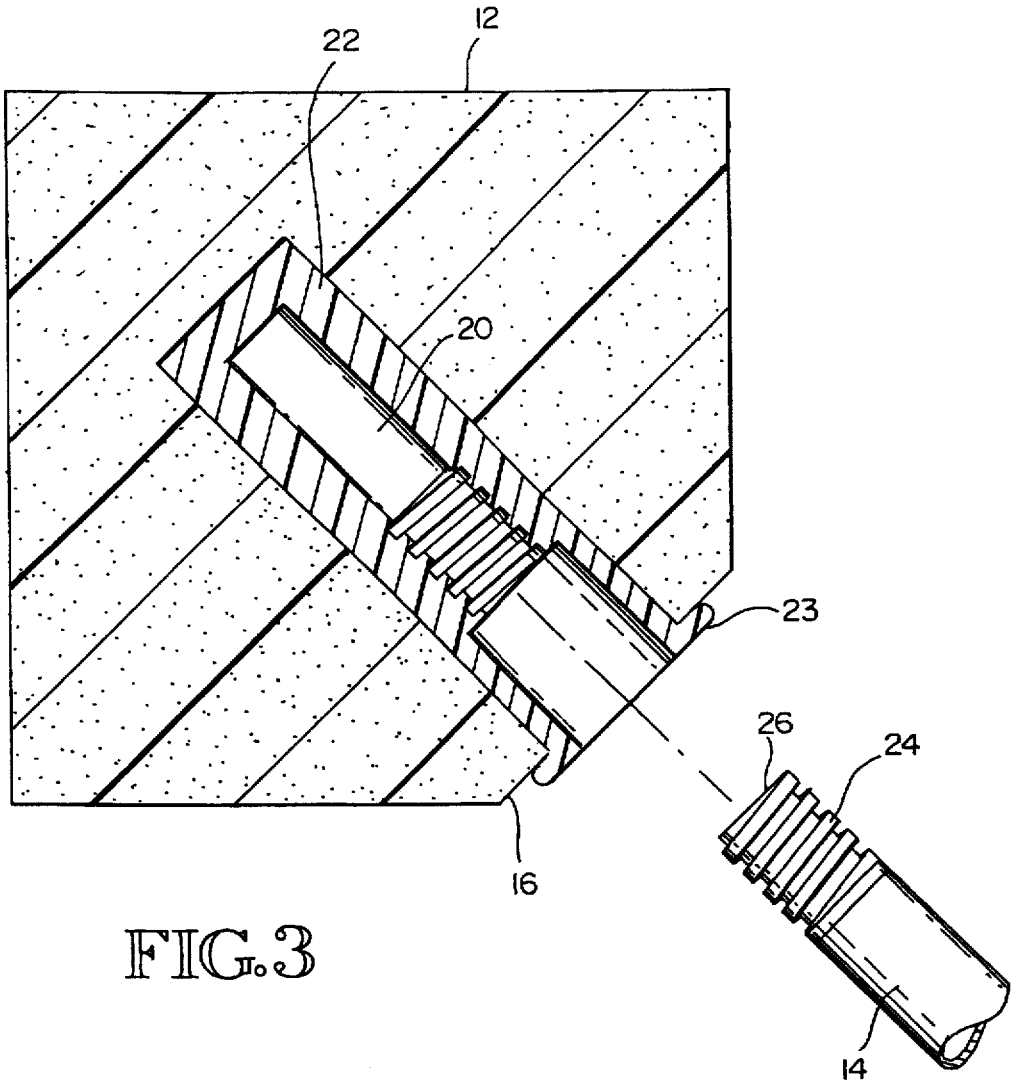
FIG. 3 is a schematic view partially in cross-section showing the hollow channel within the sponge and the threadable attachment of the end of the handle.

The present invention will now be described with reference to FIGS. 1 through 3, wherein like numerals depict the same features as between the figures.

Figure 1:
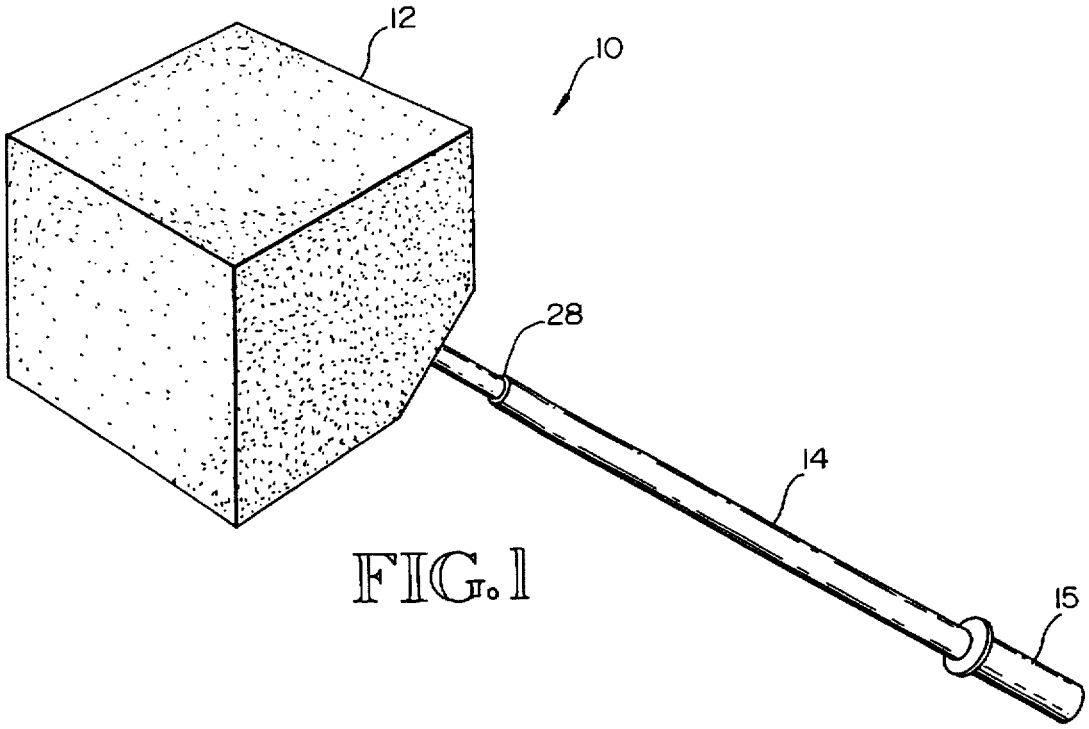
FIG. 1 is a perspective view from above and the side of the cleaning utensil of the present invention including the cube-shaped sponge and the attached handle.

Referring to FIG. 1, there is provided generally at 10 a cleaning utensil having a generally cube-shaped sponge 12 and handle 14. In FIG. 2, there is provided a better view of the underside of sponge 12 including chamfered corner 16. The surface of chamfered corner 16 defines, at substantially a centre-point (of both length and width) an opening 18, which extends within and forms hollow channel 20 (best shown in the cross-section of FIG. 3). In the embodiment shown in FIG. 3, there is provided a rigid or semi-rigid sleeve 22, which is threadably adapted to mate with threaded end 24 of handle 14. Sleeve 22 may be glued or otherwise permanently attached within hollow channel 20 and includes annular lip 23 which extends from hollow channel 20 and abuts surface 16.

Hollow channel 20 can be mated with the end 26 of handle 14 in numerous ways, each achieving the desired result of stabilizing the sponge across its length. In one embodiment, hollow channel 20 is fitted as shown in FIG. 3 with a rigid or semi-rigid sleeve which can "mate" with the end of the handle. Most preferably, the mating is by threaded attachment making the handle easily removable from the sponge as required for washing and maintenance of the sponge or handle replacement. In other cases, removal of the handle from the sponge may not be required, thereby allowing for the permanent mating of end 26 to hollow channel 20.

Whether the mating of the handle and the hollow channel is achieved with sleeve 22 or by direct permanent attachment of the end of the handle to the channel through some other means, the result is the same: enhanced stability and finger-like control of the sponge head. In a preferred form, the hollow channel extends at least half the length of the sponge in cross-section. More preferably, the channel extends ¾ of this length. In addition, the channel preferably extends symmetrically through the centre axis of the sponge (as shown in FIG. 3) thereby providing uniform stability to each edge and surface of the sponge. The combination of a ¾ extension of the channel through the sponge and symmetrical placement of the channel is the ideal form for a cubic sponge with a chamfered corner as described herein.

In a preferred form of the invention, handle 14 is telescoping as shown by join 28 in FIG. 1. There may be more than one join as required for the length of the handle. It has been found that an extendible 31½ inch long by ¾ inch wide aluminum pole works satisfactorily for most cleaning situations such as bathtub and hot tub cleaning. For other jobs, such as large pool cleaning, a longer handle with greater extension may be used. A hand grip 15 may be inserted at the distal end of handle 14.

In a preferred form, a locking device is inserted at one end of handle 14 (not shown in the figures) in order to lock onto the desired handle length, both extended and contracted. These types of locking means for telescoping handles are well known in the art. In one preferred form, two poles may be used, one having a pole diameter of ¾ inch and another having a diameter of ⅞ inch. A locking device permits on pole to slid over the other and be held in the desired position.

Although sponge 12 may be either man-made or natural, it is preferred that the sponge be a sea-sponge due to the excellent characteristics of longevity and durability of these sponges. The present invention is not limited by any particular size of sponge although in a preferred form a 5 inch by 5 inch cube sponge has been found to be very versatile. In addition, the dimensions of chamfered corner 16 will vary according to the size of the cube. For a 5 inch by 5 inch cube, the ideal is that one corner be chamfered to yield a 2¼ inch wide flat surface (shown as 16 in FIGS. 2 and 3). As discussed above, it is preferred that opening 18 be positioned in the centre of surface 16 and be, for a 5 inch by 5 inch cube, approximately 11/16 inch wide. In the ideal form for the 5 inch by 5 inch cube, the length of the channel is approximately 4 inches.

I claim:

1. A cleaning utensil comprising:

a handle defining at one end a substantially rigid portion;

a cube-shaped sponge having a chamfered corner, said corner providing a central opening extending within the sponge which forms a hollow channel, said channel being adapted to receive the portion of the handle substantially within the body of the sponge.

2. The cleaning utensil of claim 1 wherein the hollow channel extends symmetrically through at least half of the length of the sponge.

3. The cleaning utensil of claim 1 wherein the hollow channel extends symmetrically through at least three quarters of the length of the sponge.

4. The cleaning utensil of claim 1 wherein the end of the handle is threaded and the channel is formed to receive this end by means of a threaded, substantially rigid sleeve.

5. The cleaning utensil of claim 1 wherein the handle is telescoping.

6. The cleaning utensil of claim 1 wherein the handle is telescoping and additionally comprises a means for fixing the handle in an extended or contracted configuration.

7. The cleaning utensil of claim 1 wherein the sponge is a natural sponge.

8. The cleaning utensil of claim 1 wherein the sponge is a sea sponge.

* * * * *